US011478014B2

(12) United States Patent
Holmes et al.

(10) Patent No.: US 11,478,014 B2
(45) Date of Patent: Oct. 25, 2022

(54) CONDITIONING SYSTEM

(71) Applicant: Altria Client Services LLC, Richmond, VA (US)

(72) Inventors: Gregory Alan Holmes, Winston-Salem, NC (US); Carl Gregory Miller, Richmond, VA (US)

(73) Assignee: Altria Client Services LLC, Richmond, VA (US)

( * ) Notice: Subject to any disclaimer, the term of this patent is extended or adjusted under 35 U.S.C. 154(b) by 157 days.

(21) Appl. No.: 16/282,860

(22) Filed: Feb. 22, 2019

(65) Prior Publication Data

US 2020/0268037 A1 Aug. 27, 2020

(51) Int. Cl.
*A24C 5/39* (2006.01)
*A24B 3/14* (2006.01)

(52) U.S. Cl.
CPC ..... *A24C 5/399* (2013.01); *A24C 5/395* (2013.01); *A24B 3/14* (2013.01); *A24C 5/398* (2013.01)

(58) Field of Classification Search
CPC ..... A24C 5/395; A24C 5/399
USPC ..... 131/108
See application file for complete search history.

(56) References Cited

U.S. PATENT DOCUMENTS 603,488 A * 5/1898 Schmidt ..... A24C 5/005 131/35
1,724,319 A 8/1929 Schünemann
1,755,081 A 4/1930 Schünemann
1,867,463 A * 7/1932 Desmond ..... A24C 5/39 131/109.1
2,199,579 A 5/1940 Schackleton
2,214,044 A * 9/1940 Dearsley ..... A24C 5/395 131/109.3
2,388,772 A * 11/1945 Thompson ..... A24C 5/395 131/109.3
2,684,678 A * 7/1954 Walter ..... A24C 3/00 131/66.1
2,873,746 A 2/1959 Schlossmacher
3,016,906 A 1/1962 Peters
3,234,950 A 2/1966 Dearsley
3,324,622 A * 6/1967 Schmermund ..... A24C 5/354 53/151
4,050,467 A 9/1977 Van Sluis et al.
5,159,939 A * 11/1992 Marritt ..... A24C 5/18 131/109.1

(Continued)

FOREIGN PATENT DOCUMENTS

CN 203168001 U 9/2013
GB 295524 A * 8/1928 ..... A24C 5/39
GB 367373 A * 2/1938

(Continued)

*Primary Examiner* — Kelly M Gambetta
*Assistant Examiner* — Russell E Sparks
(74) *Attorney, Agent, or Firm* — Harness, Dickey & Pierce, P.L.C.

(57) ABSTRACT

At least one example embodiment discloses a conditioning system including a first roller, a second roller, a first drive system configured to rotate the first roller in a first rotational direction and rotate the second roller in a second rotational direction and a second drive system configured to move the first roller and the second roller in opposing linear directions, the first drive system and the second drive system being configured to cooperatively control the first roller and the second roller to process a substance.

22 Claims, 14 Drawing Sheets

(56) References Cited

U.S. PATENT DOCUMENTS

| | | | | | |
|---|---|---|---|---|---|
| 5,199,446 | A | | 4/1993 | Cahill et al. | |
| 5,318,201 | A | * | 6/1994 | Lowe | A24C 5/325<br>131/282 |

FOREIGN PATENT DOCUMENTS

| | | | | | |
|---|---|---|---|---|---|
| GB | 986953 | A | | 3/1965 | |
| GB | 1513155 | A | * | 6/1978 | A24C 5/39 |

* cited by examiner

CONDITIONING SYSTEM

BACKGROUND

Field

At least some example embodiments relate generally to a conditioning system.

Description of Related Art

A conditioning system may be able to process a material (e.g., a fibrous material), for example, to break up the material into smaller parts.

SUMMARY

At least one example embodiment provides a conditioning system including a first roller, a second roller, a first drive system configured to rotate the first roller in a first rotational direction and rotate the second roller in a second rotational direction and a second drive system configured to move the first roller and the second roller in opposing linear directions, the first drive system and the second drive system being configured to cooperatively control the first roller and the second roller to process a substance.

In some example embodiments, the conditioning system further includes a hopper configured to feed the substance to the first and second roller.

In some example embodiments, the conditioning system further includes a pre-distributer configure to distribute the substance into the hopper.

In some example embodiments, the second drive system is configured to move the first roller and the second roller such that the first roller and the second roller move the substance to between the first roller and the second roller.

In some example embodiments, the first roller includes a plurality of first teeth and the second roller includes a plurality of second teeth, the plurality of first teeth and the plurality of second teeth mesh with each other.

In some example embodiments, the plurality of first teeth and the plurality of second teeth mesh with each other in a non-contact manner.

In some example embodiments, the conditioning system further includes a first comb structure adjacent to the first roller and a second comb structure adjacent to the second roller, the first comb structure and the second comb structure configured to remove the substance from the plurality of first teeth and the plurality of second teeth, respectively.

In some example embodiments, the second drive system is configured to oscillate the first brush element and the second brush element.

In some example embodiments, the second drive system is configured to oscillate the first brush element in a same direction as the first roller and the second brush element in a same direction as the second roller.

In some example embodiments, the first comb structure is configured to move when the first drive system rotates the first roller.

In some example embodiments, the second comb structure is configured to move when the second drive system rotates the second roller.

In some example embodiments, the first comb structure includes a plurality of first fingers, the plurality of first fingers being between the plurality of first teeth.

In some example embodiments, a structure of the plurality of first fingers corresponds to a root radius of the first roller.

In some example embodiments, the second drive system includes spring return cams to move the first roller and the second roller.

In some example embodiments, the second drive system includes an eccentric crank to move the first roller and the second roller.

In some example embodiments, the conditioning system further includes a third roller and a fourth roller. The first drive system is configured to rotate the third roller in a first rotational direction and rotate the fourth roller in the second rotational direction.

In some example embodiments, the second drive system is configured to move the third roller and the fourth roller in opposing linear directions.

In some example embodiments, the first drive system includes a single motor and the second drive system includes a single motor.

In some example embodiments, the substance is a fibrous material.

In some example embodiments, the fibrous material is tobacco.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

DETAILED DESCRIPTION OF EXAMPLE EMBODIMENTS

Figure 1:
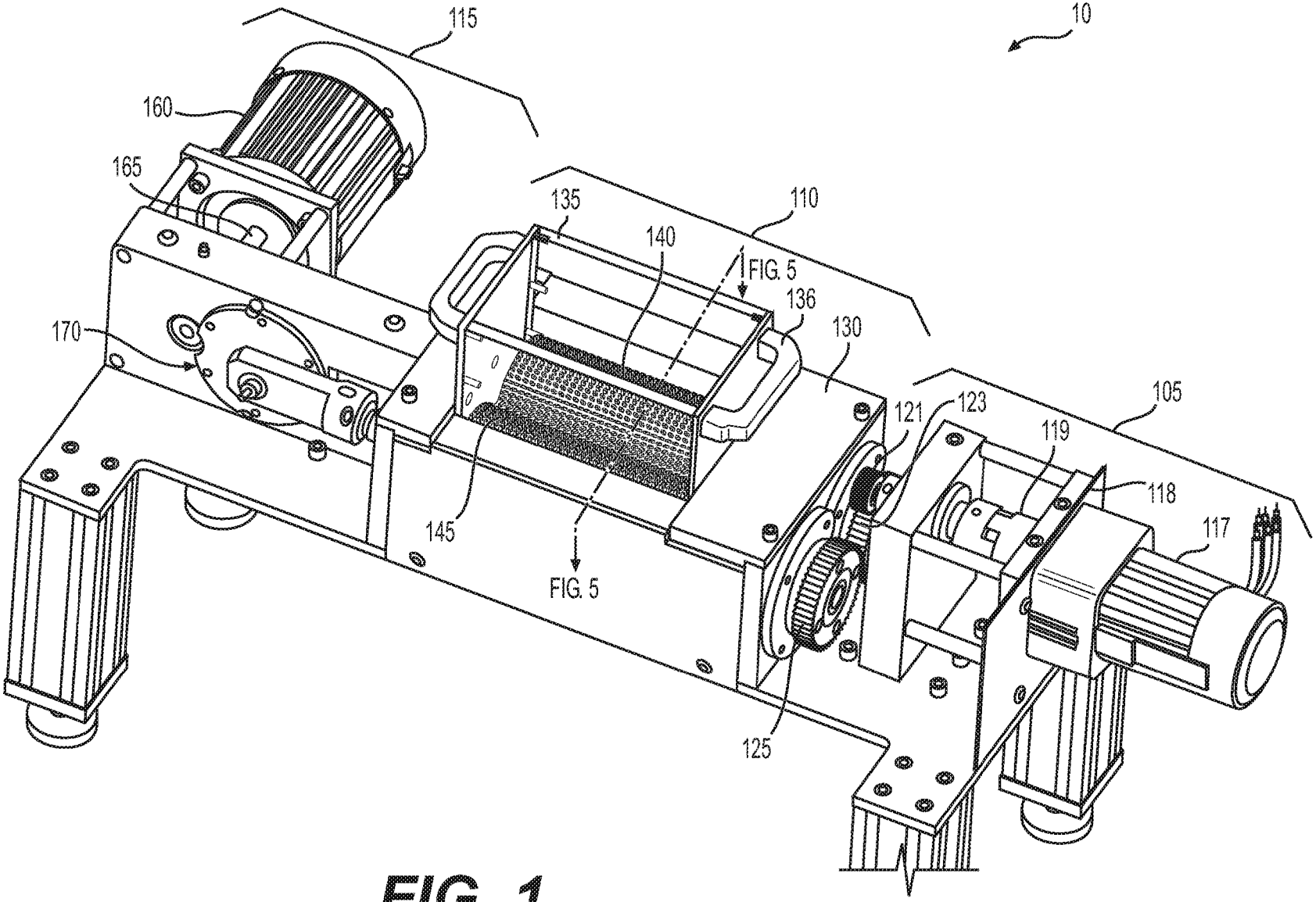
FIG. 1 is illustrates a processing system according to some example embodiments.

Some detailed example embodiments are disclosed herein. However, specific structural and functional details disclosed herein are merely representative for purposes of describing example embodiments. Example embodiments may, however, be embodied in many alternate forms and should not be construed as limited to only the example embodiments set forth herein.

Accordingly, while example embodiments are capable of various modifications and alternative forms, example embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives falling within the scope of example embodiments. Like numbers refer to like elements throughout the description of the figures.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations of one or more of the associated listed items.

It should be understood that, although the terms first, second, third, etc. may be used herein to describe various elements, components, regions, layers and/or sections, these elements, components, regions, layers, and/or sections should not be limited by these terms. These terms are only used to distinguish one element, component, region, layer, or section from another region, layer, or section. Thus, a first element, component, region, layer, or section discussed below could be termed a second element, component, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various example embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

Example embodiments disclose a system for processing materials. For example, in some example embodiments, the system processes the material by removing loosening and mixing the material. For example, the material may be a fibrous material such as tobacco. However, example embodiments are not limited thereto and the material may be food, pharmaceuticals, coffee or any other granular, powder, fibrous or other product that tends to clump or aggregate. In example embodiments, the material may be broken up or made loose for processing, portioning, packaging or other purposes, for example.

In an example embodiment, the system may include one or more pairs of counter-rotating and oscillating toothed rollers that pull the material from one or more feed hoppers and push the material through gaps created between the teeth on the rollers. In addition to the rotational motion, the rollers can also maintain an oscillating linear motion relative to each other. The oscillating motion breaks up clumps of the material present in the stock. By using both rotational and oscillating motions the processed materials are homogeneous and suitable for further processing such as packaging or portioning. The system may further include combs to remove material which may stick to the rollers or become embedded in the teeth of the rollers. The combs oscillate along with the rollers and aid in removing the material from the rollers.

Moreover, the use of the rotational and oscillating motions allow for a larger amount of material to be used in the hopper.

FIG. 1 illustrates an example embodiment of a processing system 10. The processing system 10 may also be referred to as a conditioning system.

The processing system 10 includes a first drive system 105, a processing portion 110, and a second drive system 115, arranged in a linear fashion. The first drive system 105 is configured to provide a rotational force to allow for rotational motion within the processing portion 110. The second drive system 115 provides an oscillating force to allow for oscillating motion within the processing portion 110.

The first drive system 105 includes a motor 117, a mounting apparatus 118, a coupler 119, and a spur gear. The spur gear includes a pinion 121, a first gear 123, and a second gear 125.

The pinion 121, the first gear 123 and the second gear 125 are configured to provide the rotational force to the processing portion 110.

The processing portion 110 includes a housing 130, a hopper 135, handles 136 on the hopper 135, a first roller 140 and a second roller 145. The pinion 121, the first gear 123 and the second gear 125 apply rotational forces to the first roller 140 and the second roller 145 that forces the first roller 140 and the second roller 145 to rotate in opposite directions. The first roller 140 the second roller 145 rotate in a manner to permit a material in the hopper 135 to be processed as it moves between a spacing between the first roller 140 and the second roller 145.

The second drive system 115 includes a motor 160, a shaft 165 and a crank shaft system 170. The motor 160, the shaft 165 and the crank shaft system 170 provide linear oscillating motions in opposing directions to the first and second rollers 140 and 145, respectively. More specifically, the motor 160, the shaft 165 and the crank shaft system 170 allow the first and second rollers 140 and 145 to linearly oscillate in opposite directions.

Figure 2:
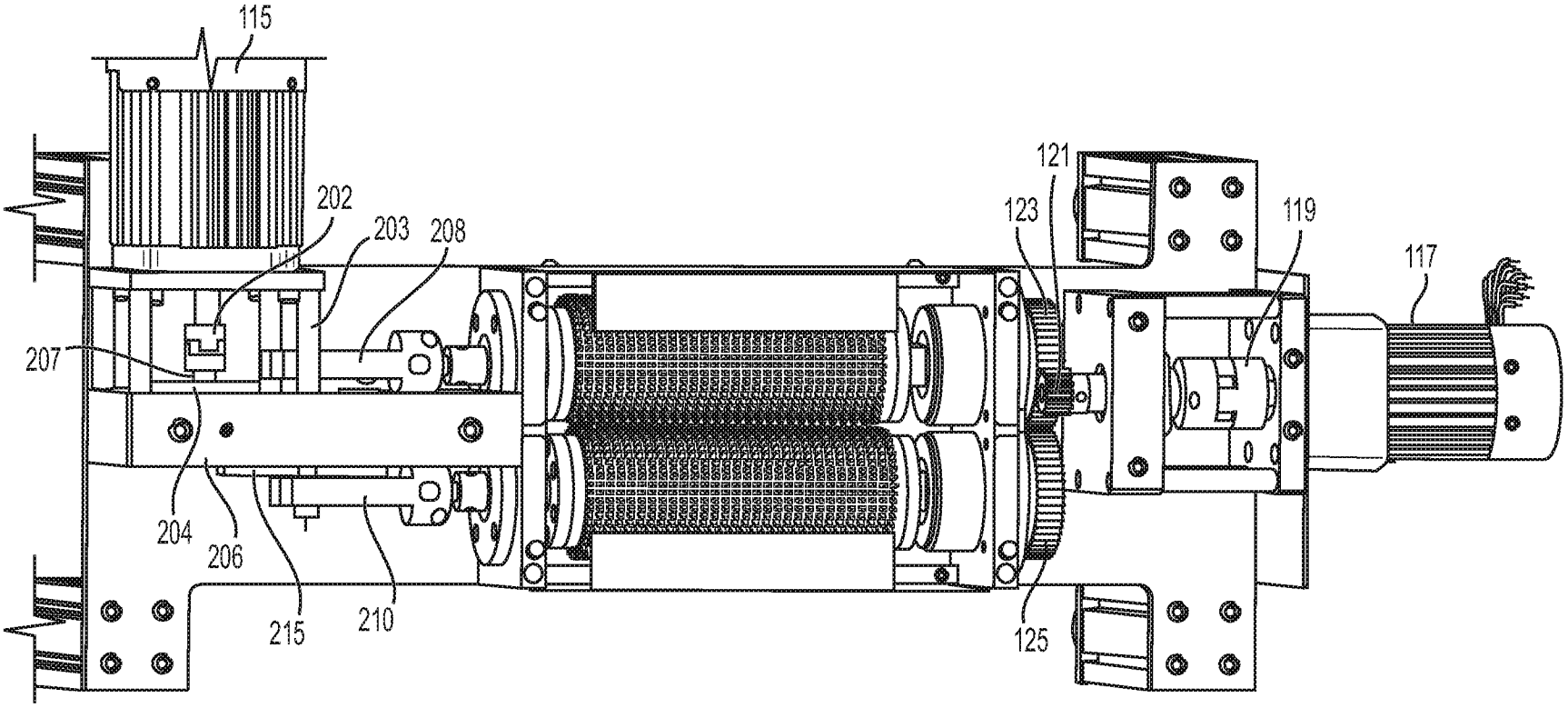
FIG. 2 illustrates top view of the processing system shown in FIG. 1.

FIG. 2 illustrates a top view of the processing system 10. As shown, the second drive system 115 further includes a coupler 202, a bearing retainer 204, a central mount 206, a first crank arm assembly 208, a second crank arm assembly 210, a bearing retainer 215 and a mounting post 203. The mounting post 203 connects the motor mounting plate 302 to the central mount 206. The shaft 165 of the motor 160 is connected to the coupler 202. The coupler 202 couples the shaft 165 to a driveshaft 207. The driveshaft 207 is connected to a spur gear 310 (shown in FIG. 3). The bearing retainer 204 provides a space therethrough for the driveshaft 207 to extend from the spur gear 310 to the coupler 202. The coupler 202 allows the rotational force provided by the motor 160 to be applied to the driveshaft 207.

Figure 3A:
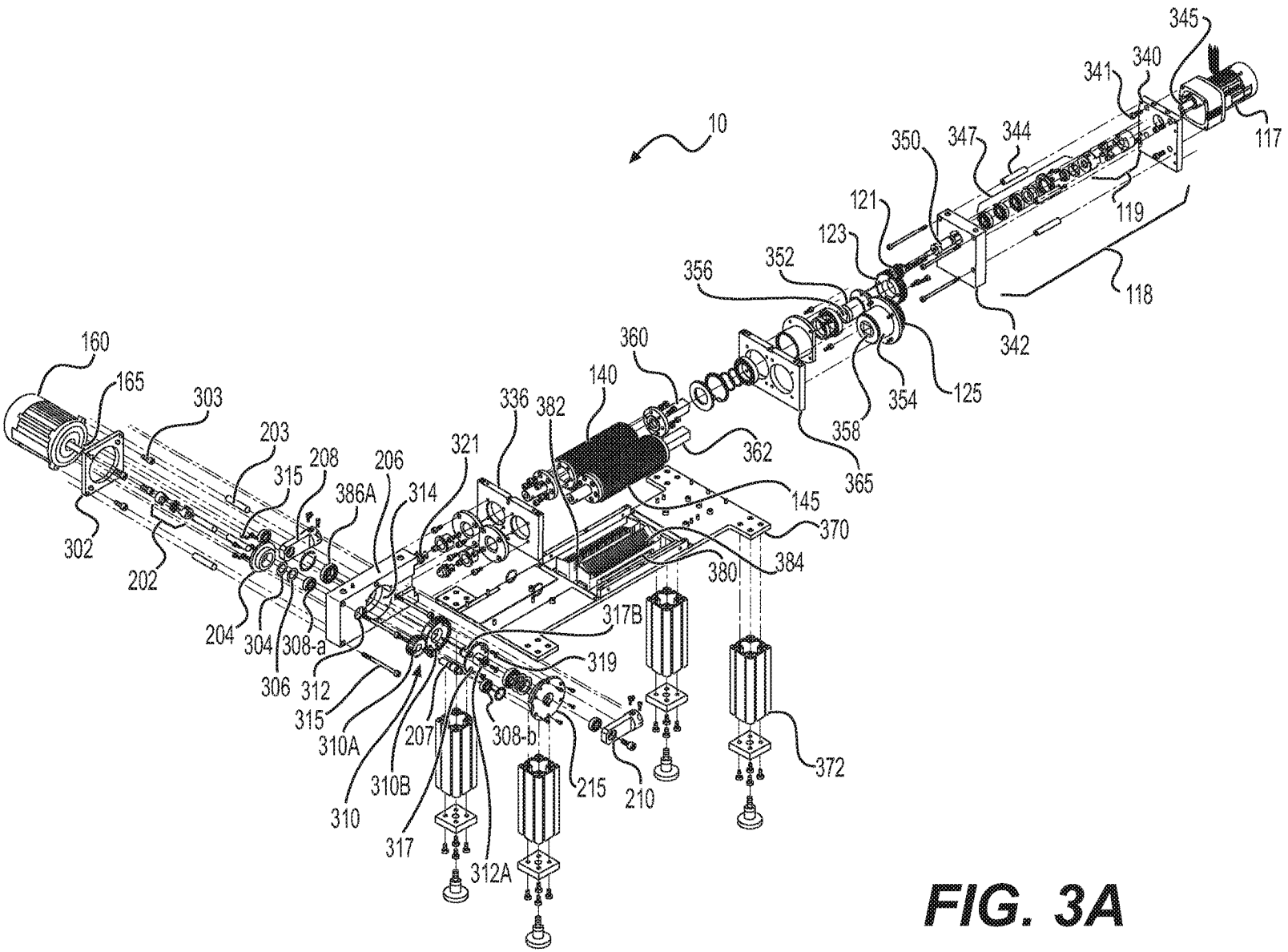
FIG. 3A illustrates an exploded view of the processing system shown in FIG. 1.

FIG. 3A illustrates an exploded view of the processing system 10. As shown in FIG. 3A, the motor 160 is connected to a motor mounting plate 302. The motor mounting plate 302 is square and coupled to the motor 160 by screws 303. Bolts 315 are inserted into the central mount 206, pass through the mounting posts 203 and are coupled to the motor mounting plate 302 to attach the motor 160 to the central mount 206.

The motor mounting plate 302 defines a circular space therethrough. The shaft 165 protrudes through the circular space in the motor mounting plate 302, where it is connected to the coupler 202.

The central mount 206 includes two overlapping cylindrical bores which house the spur gear 310, a first cylindrical bore 312 and a second cylindrical bore 314. The second cylindrical bore 314 has a diameter greater than a diameter of the first cylindrical bore 312.

The first cylindrical bore 312 houses the drive gear 310*a*, which is connected to the drive shaft 207. The drive shaft 207 is supported by bearings 308-*a* and 308-*b*. The bearing 308-*b* is mounted in the first cylindrical bore 312, and the bearing 308-*a* is mounted in the bearing retainer 204, which is in turn mounted in the first cylindrical bore 312. Spring washers 304 and 306 are located between an outer face of the bearing 308-*a* and the bearing retainer 204 to hold the drive shaft 207 and the drive gear 310*a* in position. The drive shaft 207 is connected to the shaft 165 by the coupler 202.

The second cylindrical bore 314 houses the driven gear 310*b* and the crank shaft 317, which is connected to the driven gear 310*b* by screws 319. The crank shaft 317 is supported by the bearings 381-*a* and 381-*b*. The bearing 381-*a* is mounted in the first cylindrical bore 312, and the bearing 381-*b* is mounted in the bearing retainer 215, which is in turn mounted in the second cylindrical bore 314. Spring washers 383 are located between the outer face of the bearing 381-*b* and the bearing retainer 215 to hold the crank shaft 317 and the driven gear 310*b* in position. Rotational force provided by the motor 160 causes the drive gear 310*a* to be rotated. The drive gear 310*a* is configured to rotate the driven gear 310*b* and the crank shaft 317 using the rotational force provided by the motor 160.

An eccentric protrusion 317*a* extends through a central bore of the bearing retainer 215 and into a bearing fixed in the crank arm assembly 210. The eccentric protrusion 317*a* is fixed to the crank arm assembly 210 by a shoulder screw 385. When the crank shaft 317 is rotated by the driven gear 310*b*, the eccentric protrusion 317*a* causes the second crank arm assembly 210 to move in a linear oscillating motion.

Similarly, an eccentric protrusion 317*b* is fixed to the first crank arm assembly 208 by a shoulder screw 386*a*. When the crank shaft 317 is rotated by the driven gear 310*b*, the crank arm assembly 208 converts the rotational motion of the crank shaft 317 to a linear motion of the first and second rollers 140 and 145. The end of the crank arm assembly 208 that is attached to the eccentric protrusion 317*b* moves in a circular motion, and the opposite end of the crank arm assembly 208 that is attached to the ball and socket universal joint 321 moves in a linear oscillating motion.

The eccentric protrusions 317*a* and 317*b* are configured on the crank shaft 317 such that they cause the first crank arm assembly 208 and the second crank arm assembly 210 to move in opposing directions.

Shafts 396*a* and 396*b* are attached to the first and second rollers 140 and 145, respectively, by screws 397. The shafts 396*a* and 396*b* are supported by bearings 398*a* and 398*b*, respectively. The bearings 298*a* and 398*b* are attached to bearing mounting plates 399*a* and 399*b*, respectively, which are attached to the mounting plate 336 by screws 400.

The bearings 398*a* and 398*b* fix the axes of the shafts 396*a* and 396*b*, respectively, and thus the first and second rollers 140 and 145, respectively, while allowing the shafts 396*a* and 396*b* and, thus, the first and second rollers 140 and 145 to rotate and oscillate axially.

The shafts 396*a* and 396*b* are connected to the first crank arm assembly 208 and the second crank arm assembly 210 by ball and socket universal joints 321*a* and 321*b*, respectively. In some example embodiments, each of the ball and socket universal joints 321*a* and 321*b* allows angular motion between a crank arm assembly and a roller and a rotation of a roller while driving the oscillating motion of the roller.

More specifically, the ball and socket universal joints 321*a* and 321*b* allow the first crank arm assembly 208 and the second crank arm assembly 210 to move angularly relative to the shafts 396*a* and 396*b*, respectively. The ball and socket universal joints 321*a* and 321*b* also allow the shafts 396*a* and 396*b* and, thus, the first and second rollers 140 and 145 to rotate relative to the first crank arm assembly 208 and the second crank arm assembly 210, respectively. This may occur while transmitting the linear oscillating motion from the first crank arm assembly 208 and the second crank arm assembly 210 to the shafts 396*a* and 396*b*, respectively, and thus the first and second rollers 140 and 145.

With respect to at least some example embodiments of the first drive system 105 (shown in FIG. 3C), the motor 117 is attached to a mounting plate 340 by screws 341. In addition to the mounting plate 340, the mounting apparatus 118 further includes a bearing housing plate 342, spacers 344 and screws 385. The mounting plate 340 and the bearing housing plate 342 are connected together by the screws 385 and the spacers 344 disposed between the mounting plate 340 and the bearing housing plate 342.

The coupler 119 is connected to the shaft 345 of the motor 117. More specifically, the shaft 345 extends through a circular opening in the mounting plate 340 and connects to the coupler 119. The coupler 119 is between the mounting plate 340 and the bearing housing plate 342.

The shaft 345 is attached to the coupler 119 at a first surface of the coupler 119. At an opposing second surface of the coupler 119, the coupler 119 is connected to a driving shaft 350. More specifically, the driving shaft 350 is connected to the coupler 119 and extends through a circular bore in the bearing housing plate 342. The driving shaft 350 is supported by bearings 386 which are separated by spacers 387. The bearings 386 are located within the circular bore in the bearing housing plate 342. An outer race of the bearings 386 are held in the bearing housing plate by the spring washers 388 and the bearing retainer 389. The bearing retainer 389 is fixed to the bearing housing plate 342 by screws 390. The driving shaft 350 is secured axially to the inner race of the bearings 386 by the locknut 392 and the spacer 391. The driving shaft 350 is connected to the pinion 121. Using the rotational force provided by the motor 117, the driving shaft 350 rotates the pinion 121. Rotation of the pinion 121 causes the first gear 123 and the second gear 125 to rotate in opposite directions. Scallops on the circular bore may provide access to an outer race of the bearings 386 such that the bearings 386 may be pressed out if they are to be replaced.

Figure 3B:
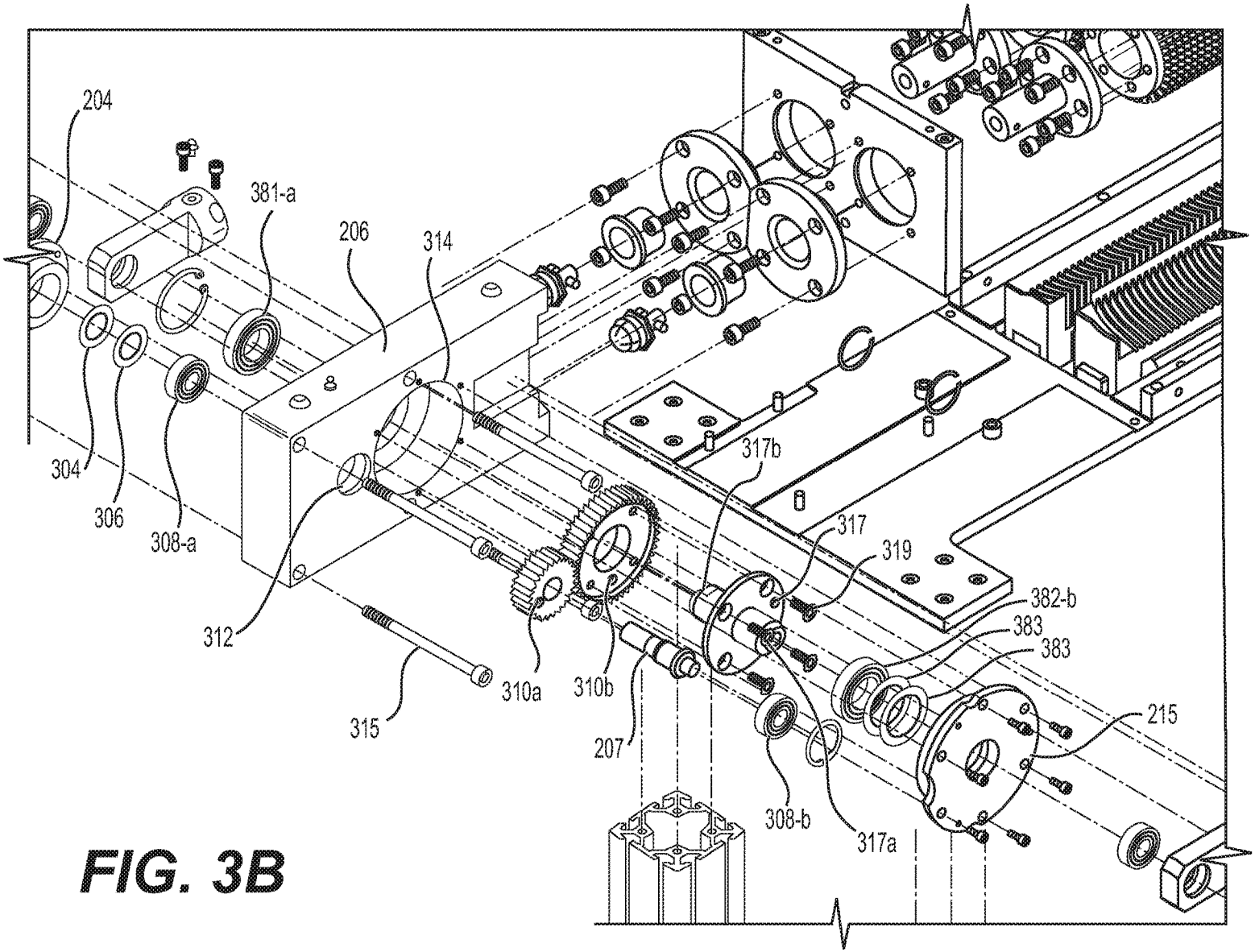
FIGS. 3B-3E illustrate sections of the processing system shown in FIG. 3A.
Figure 3C:
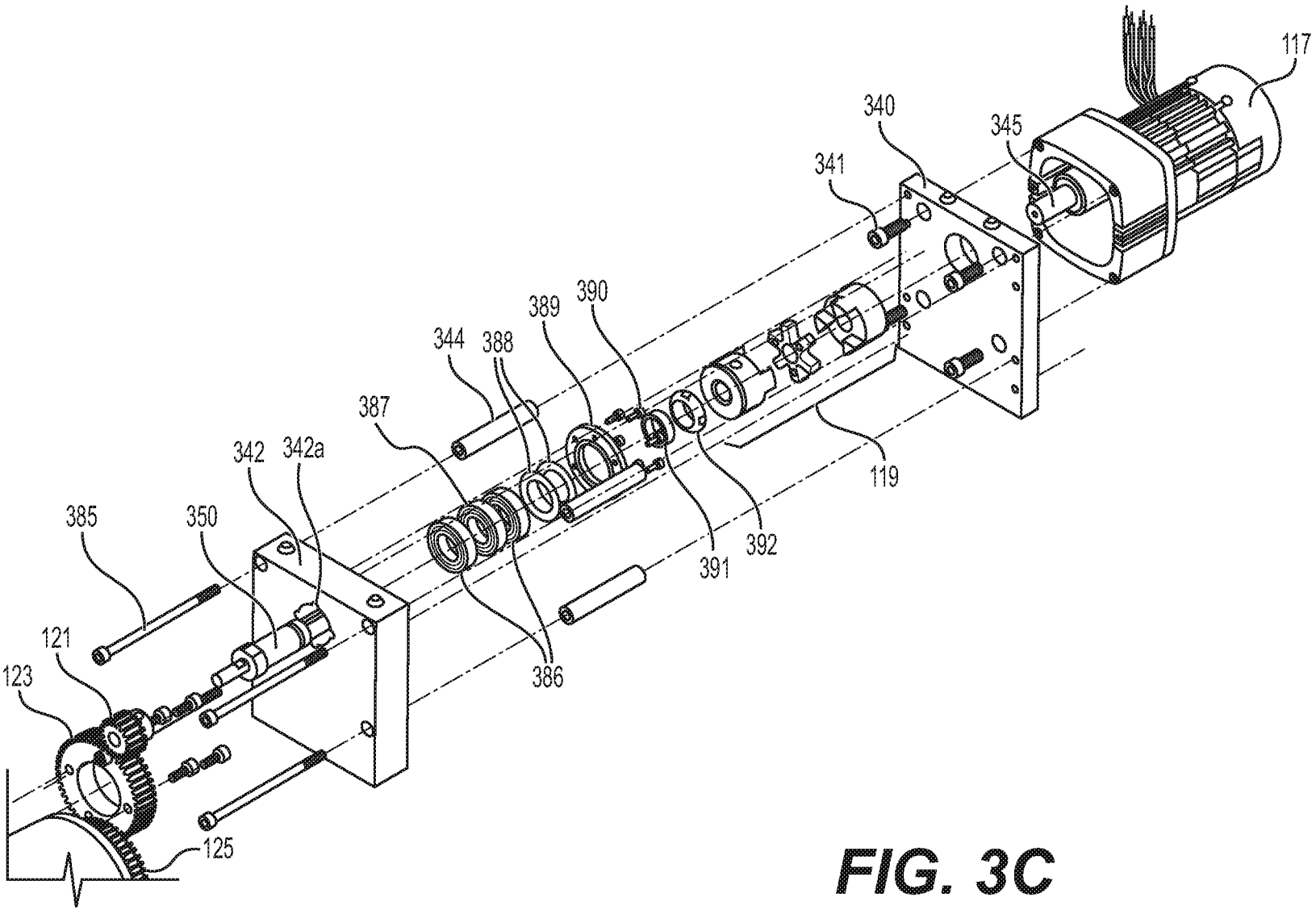
Figure 3D:
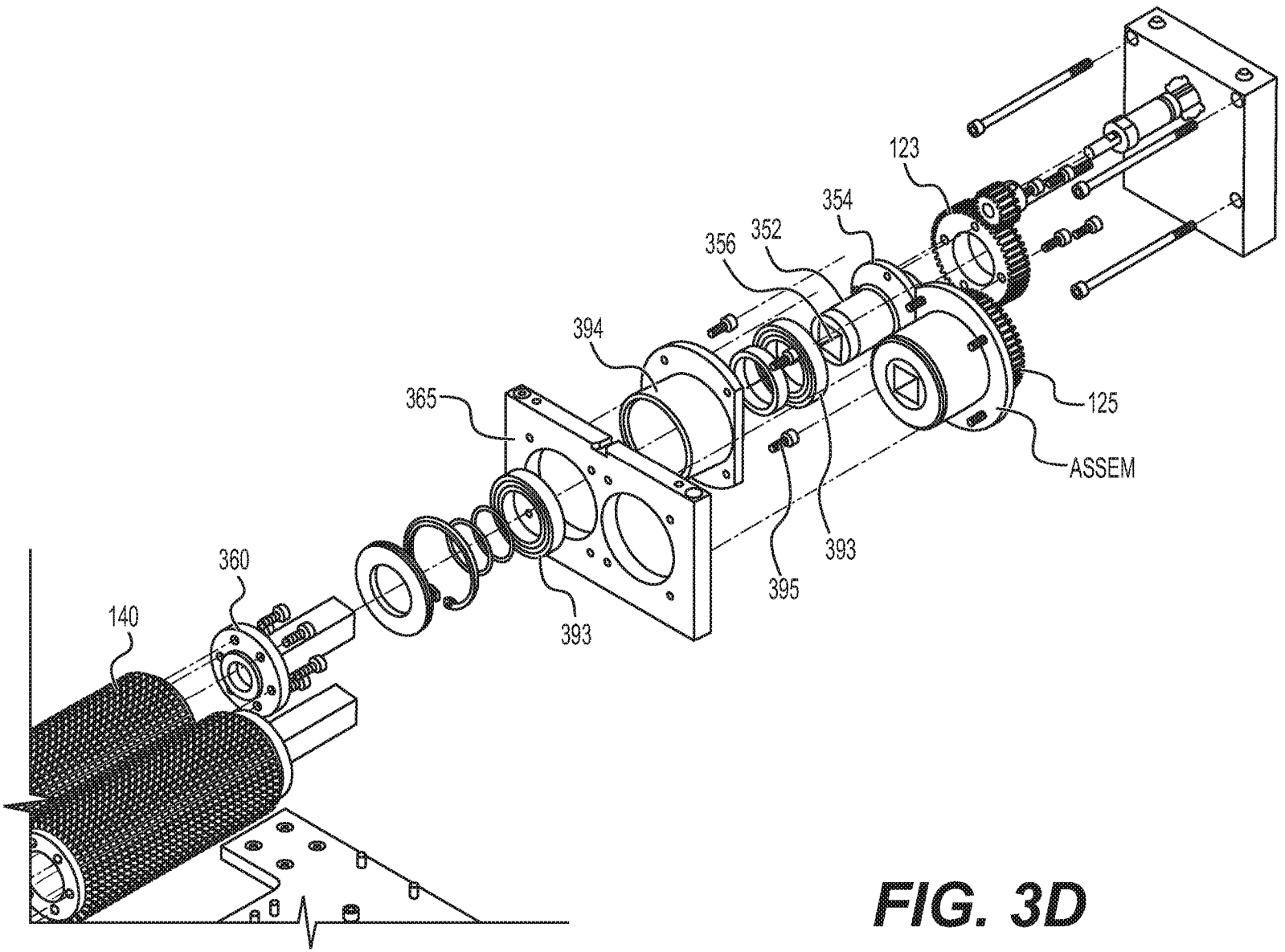
Figure 3E:
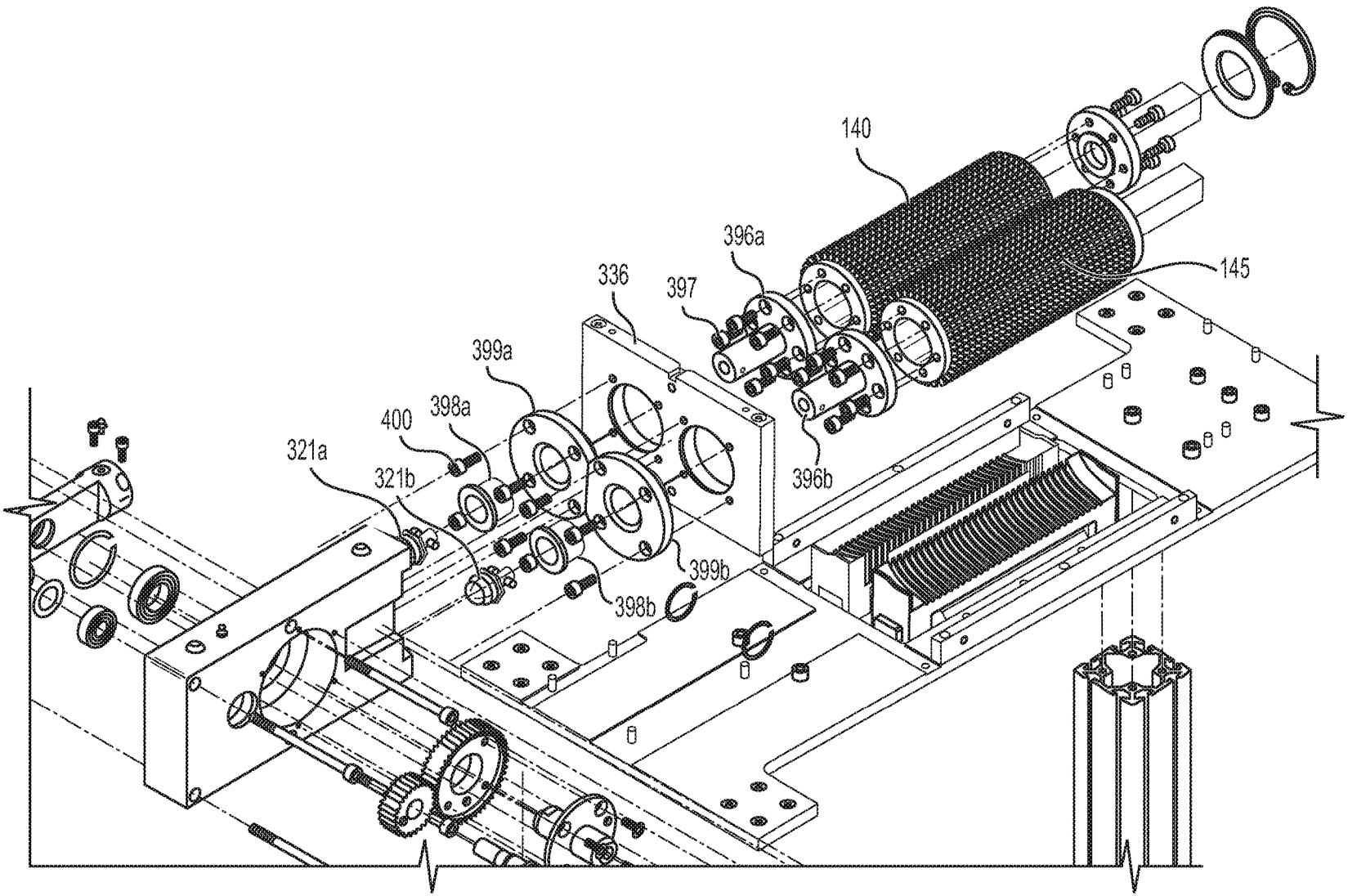

Referring to the portion of the processing system 10 shown in FIG. 3D, in at least some example embodiments, the first gear 123 and the second gear 125 are each connected to a hollow driving shaft 352. In FIG. 3D, the first gear 123, a hollow driving shaft 352, bearings 393 and a bearing housing 394 are shown as exploded. For convenience, the second gear 125 and associated hollow plate, bearings and bear housing are assembled in the same manner and, thus, are not shown in an exploded view, but shown in an assembled manner (shown as an assembly ASSEM).

The hollow driving shaft 352 includes a mounting surface 354 on which the first gear 123 is attached and a receiving area 356. The receiving area 356 is shaped to receive the shaft 360 of the first roller 140.

As shown in some example embodiments, the receiving area 356 and the shaft 360 are square shaped such that when the gears 123 and 125 are rotated, the forces transferred to the shafts 360 cause the first and second rollers 140 and 145 to rotate in opposite directions. More specifically, the first gear 123 causes the first roller 140 to rotate in a first direction and the second gear 125 causes the second roller 145 to rotate in a second direction. The square receiving area 356 and shaft 360 allow the shaft 360 to move axially within the receiving area 356 while at the same time driving the rotary motion of the first roller 140 (the same applies to the second roller 145).

The hollow driving shaft 352 is supported by the bearings 393 which are mounted within the bearing housing 394. The bearing housing 394 is attached to a mounting plate 365 with screws 395. The shaft 360 of the first roller 140 extends through one of two holes in the mounting plate 365 to engage in the receiving area 356.

It should be understood that the shaft 360 of the second roller 145 extends through the remaining hole of the two holes in the mounting plate 365 to engage in a receiving area of the assembly ASSEM.

In FIG. 3D, the first gear 123, hollow driving shaft 352, the bearings 393 and the bear housing 394 are shown as exploded. For convenience, the second gear 125 and associated hollow plate, bearings and bear housing are shown in an assembled manner.

Referring back to FIG. 3A, the plates 336 and 365 are mounted on a horizontal support 370. The horizontal support 370 is attached to four vertical legs 372.

A comb structure 380 is located in the middle of the horizontal support 370. The comb structure 380 includes a first comb section 382 and a second comb section 384. The first comb section 382 and the second comb section 384 include arced surfaces. Arcs of the arced surfaces of the first comb section 382 and the second comb section 384 match (e.g., are similar and/or the same) the arcs of the first and second rollers 140 and 145, respectively.

The first comb section 382 removes material which may stick to the first roller 140 or become embedded in the teeth of the first roller 140. The second comb section 384 removes material which may stick to the second roller 145 or become embedded in the teeth of the second roller 145.

The first and second comb sections 382 and 384 are mounted to the horizontal support 370 using a comb mount and a comb support rod to allow the first and second comb sections 382 and 384 to oscillate along with the first and second rollers 140 and 145. In some example embodiments, the linear oscillation of the first and second rollers 140 and 145 cause the first and second comb sections 382 and 384 to contact the first and second rollers 140 and 145 and linear oscillate with the first and second rollers 140 and 145.

Figure 4A:
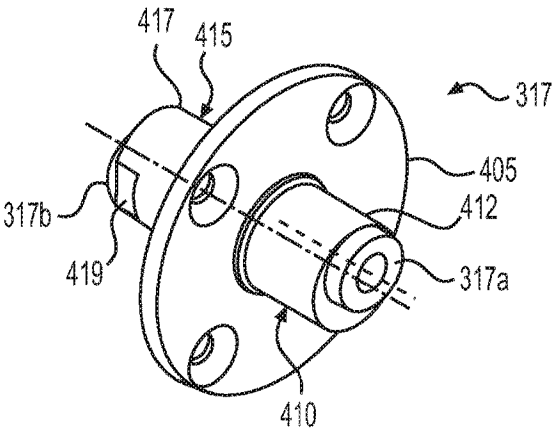
FIGS. 4A-4D illustrate various views of a crank shaft shown in FIG. 1 according to some example embodiments.

FIGS. 4A-4D illustrate various view of the crank shaft 317 shown FIGS. 3A-3B, according to certain example embodiments. As shown in FIG. 4A, the crank shaft 317 may include a disc 405, a firm arm 410 and a second arm 415. The first arm 410 and the second arm 415 extend in opposite directions from the disc 405.

The first arm 410 may include a concentric portion 412 and the eccentric protrusion 317*a* extending from the disc 405 in that order. In some example embodiments, the concentric portion 412 is cylindrical.

The second arm 415 may include a first concentric portion 416, a second concentric portion 417 and the eccentric protrusion 317*b* extending from the disc 405 in that order. In some example embodiments, the second concentric portion 417 has a curved side surface except for wrench flats 419.

Figure 4B:
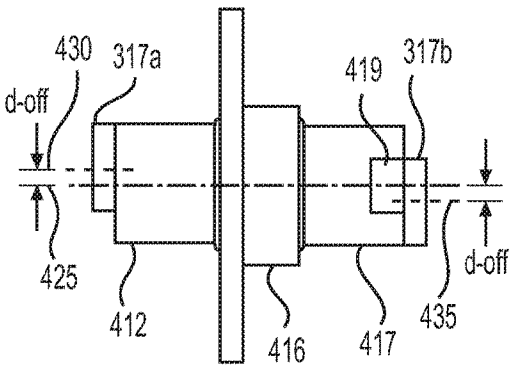

As shown in FIG. 4B, the concentric portion 412, the first concentric portion 416 and the second concentric portion 417 have a same center axis 425. A center axis 430 of the eccentric protrusion 317*a* is offset from the center axis 425 by an offset distance d-off. A center axis 435 of the eccentric protrusion 317*b* may also be offset from the center axis 425 by the offset distance d-off such that the center axis 425, the center axis 430 and the center axis 435 are parallel.

Figure 4C:
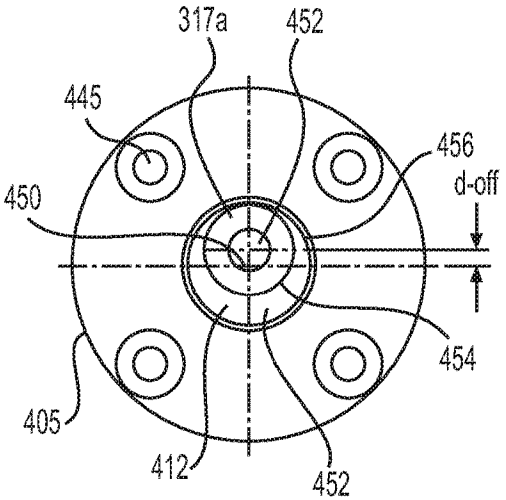

As shown in FIG. 4C, the disc 405 may define four through-holes 445 equally spaced from a center 450 of the disc 405. The center axis 425 may pass through the center 450. The disc 405 may include threads exposed to the through-holes to engage the screws 319. In some example embodiments, the eccentric protrusion 317*a* is on a base (end surface) 452 of the concentric portion 412 and has a side surface 454 that partially aligns with a side surface 456 of the concentric portion 412. A diameter of the side surface 454 is less than a diameter of the side surface 456.

Figure 4D:
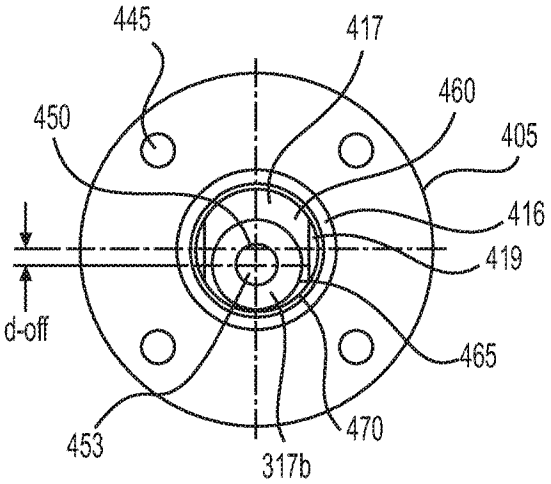

As shown in FIG. 4D, the disc 405 may define four through-holes 445 equally spaced from a center 450 of the disc 405. The center axis 425 may pass through the center 450. The disc 405 may include threads exposed to the through-holes to engage the screws 319. In some example embodiments, the eccentric protrusion 317*b* is on a base (end surface) 460 of the second concentric portion 417 and has a side surface 465 that partially aligns with a side surface 470 of the second concentric portion 417. A diameter of the side surface 465 is less than a diameter of the side surface 470.

In some example embodiments, the through holes 445 are not threaded; the screws 319 pass through the disc 405 and secure the disc 405 to the gear 310b, which includes threaded holes. Holes 452 and 453 in the eccentric protrusions 317*a* and 317*b* are threaded to receive the screws that secure the crank arm assemblies 208 and 210 to the crank shaft 317. Wrench flats 419 hold the crank shaft 317 while the screws are tightened.

Figure 5A:
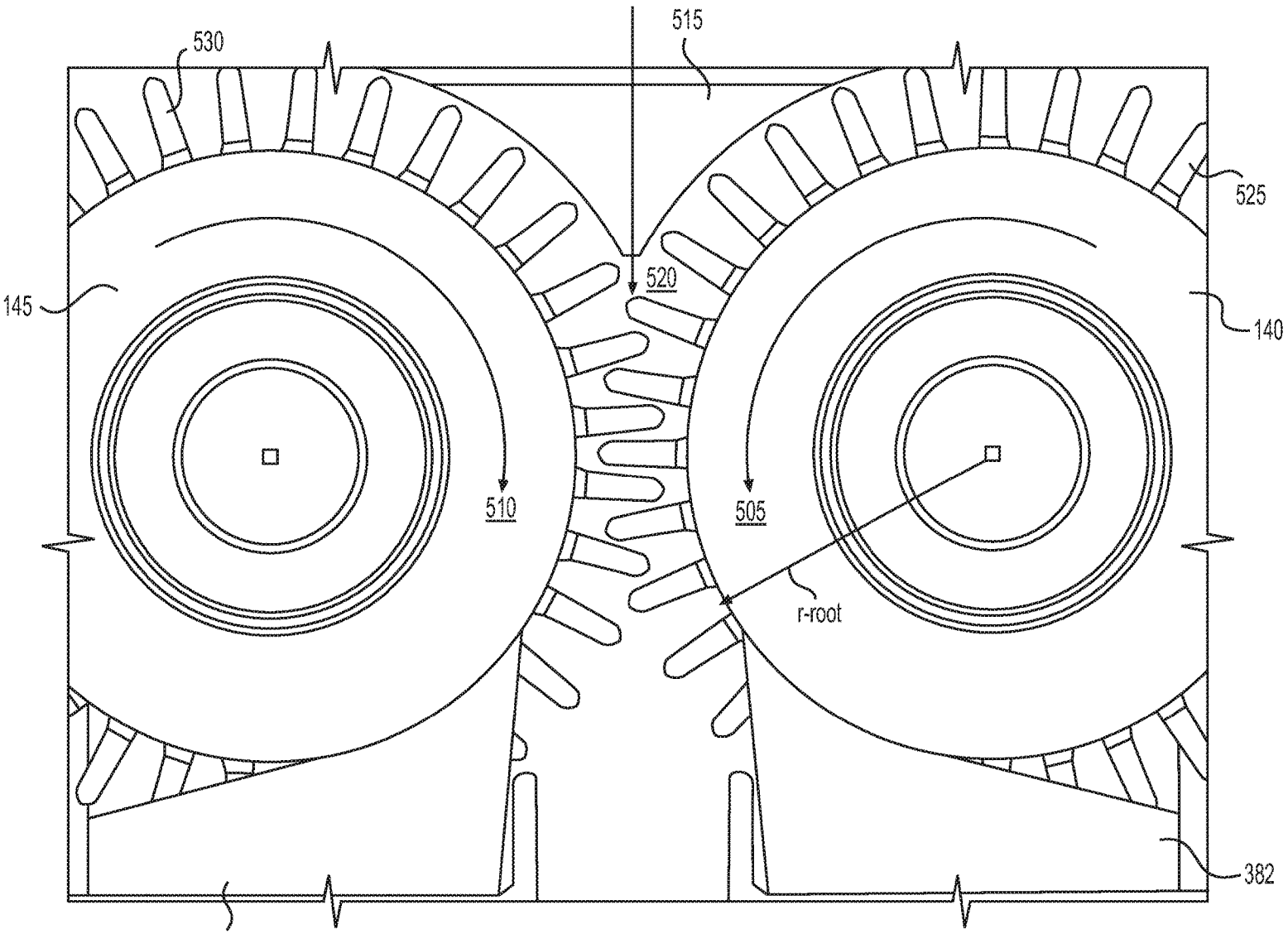
FIG. 5A illustrates a cross-sectional view of the processing system along line 5-5' in FIG. 1.
Figure 5C:
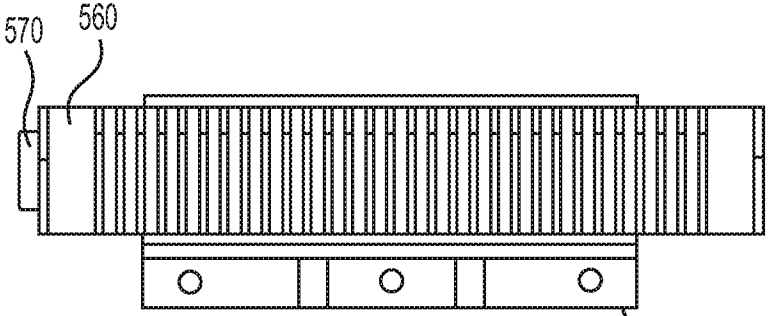
FIGS. 5B-5E illustrate various views of a comb section shown in FIG. 5A.

FIG. 5A illustrates a cross-sectional view of the first and second rollers 140 and 145 along the line 5-5', as shown in FIG. 1. The first drive system 105 causes the first roller 140 to rotate in a first direction 505 and causes the second roller 145 to rotate in a second direction 510. The first direction 505 and the second direction 510 are opposite directions. The first roller 140 and the second roller 145 rotate in opposite directions to process the material 515 in a downward direction 520.

The first roller 140 includes a plurality of teeth 525 and the second roller 145 includes a plurality of teeth 530. The plurality of teeth 525 and 530 project from a root radius r-root. The rollers 140 and 145 are arranged such that the teeth 525 and 530 do not contact each other, but cooperate to process the material 515 in the downward direction 520. In some example embodiments, the teeth 525 and 530 have the same structure.

In some example embodiments, the first and second rollers 140 and 145 and the teeth 525 and 530 are made of stainless steel. In other example embodiments, the first and second rollers 140 and 145 and the teeth 525 and 530 may also be made of aluminum, with or without a coating or surface treatment such as anodizing, another metal, a plastic material, a sub-combination thereof or a combination thereof.

Figure 5D:
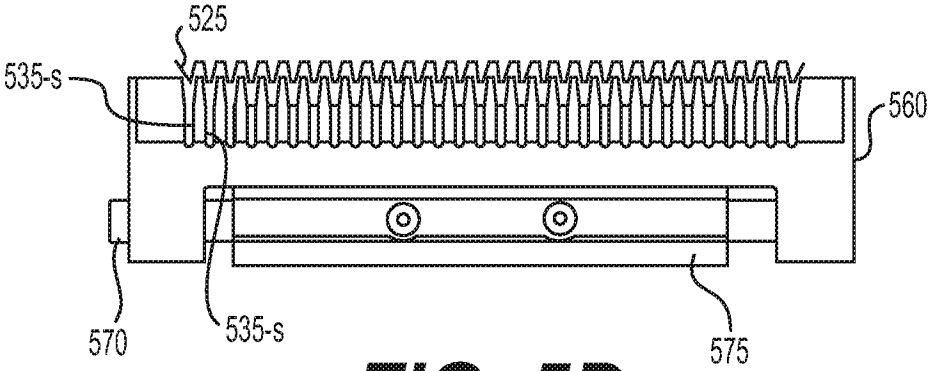
Figure 5B:
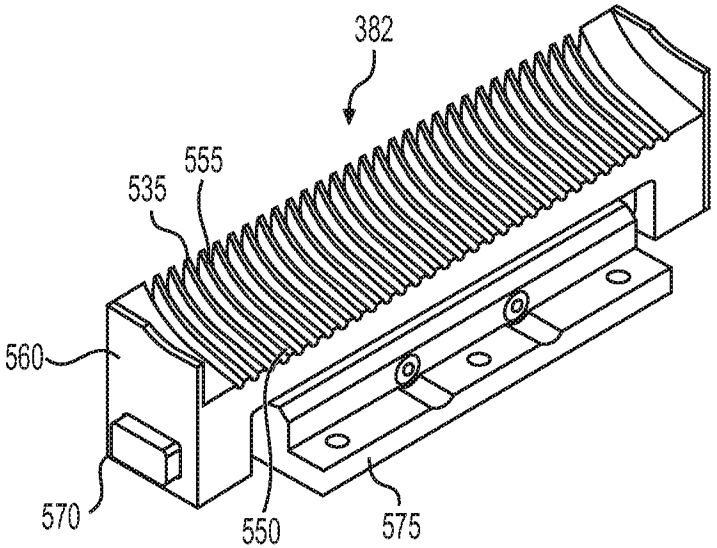

FIGS. 5B illustrate various views of the first comb section 382 of the comb structure 380. The second comb section 384 of the comb structure 380 may have the same structure in some example embodiments.

The first comb section 382 of the comb structure 380 includes a plurality of fingers 535 and the second comb section 384 of the comb structure 380 includes a plurality of fingers 540.

The fingers 535 and 540 of the first and second comb sections 382 and 384 are arranged such that they reside within spaces (e.g., 651 shown in FIG. 6C) between the teeth 525 and 530 of the first and second rollers 140 and 145.

Referring to FIG. 5B, the fingers 535 (and similarly the fingers 540) having an angled portion 550 and a curved portion 555. The angled portion 550 is a flat surface and extends from a body 560 at an angle to the curved portion 555. The curved portion 555 extends from the angled portion 550 to a tope surface of the finger 535. The curved portions 555 are curved to generally follow the root radius r-root. As a result, the curved portions follow the spaces (e.g., 651 shown in FIG. 6C) between the teeth 425 and 430 of the first and second rollers 140 and 145 when the rollers are viewed from the side.

In some example embodiments, the body 560 and the fingers 535 may be an integral piece.

In one example embodiment, the fingers 535 and 540 are made of a plastic material such as Delrin®. The fingers could also be made of stainless steel, aluminum, with or without a coating or surface treatment such as anodizing, another metal, another plastic material, a sub-combination thereof or a combination thereof. The material of construction of the fingers 535 and 540 may vary depending upon the characteristics of the material 515 that is to be processed. In some example embodiments, the material of the fingers 535 and 540 is softer than the material of the teeth 525 and 530.

Figure 5E:
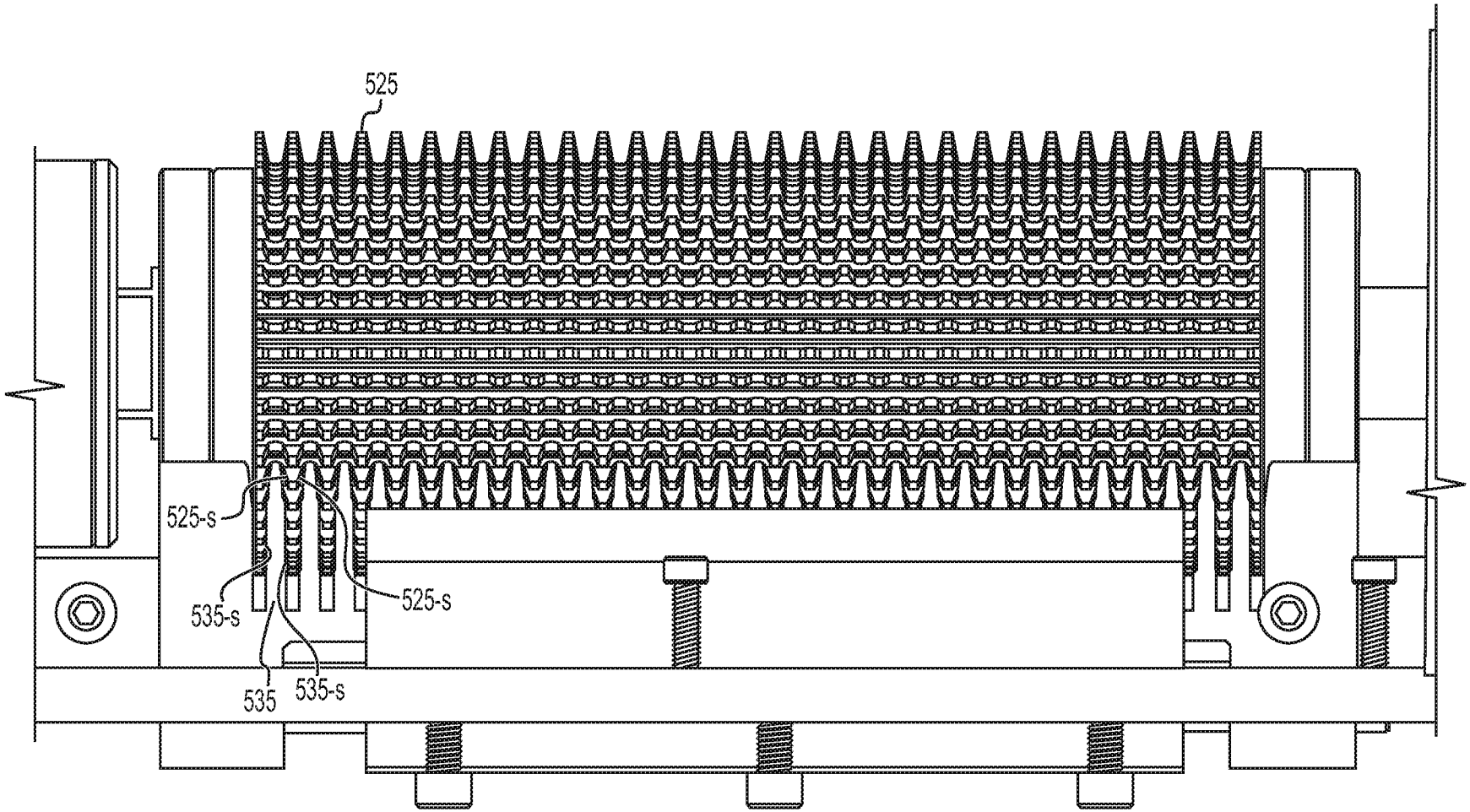

As shown in FIGS. 5D-5E, the fingers 535 may have sides 535-*s* and the shape of the fingers 535 and 540 may correspond to the shape of the spaces between the teeth 525 and 530. In some example embodiments, the size of the fingers 535 and 540 is slightly smaller than the size of the spaces between the teeth 525 and 530 such that there is a clearance of between a finger and an adjacent tooth. The sides 535-*s* may engage with sides 525-*s* of the teeth 525 during the linear oscillation.

For example, the clearance may be approximately 0.5 mm to 1.0 mm between all surfaces of a finger 535 or 580 and all surfaces of an adjacent tooth 525 or 530.

In other example embodiments, the shape of the fingers 535 and 540 and the spacing between two adjacent teeth 525 or 530 may be different that the shapes illustrated.

Still referring to FIGS. 5B-5E, the first comb section 382 can include a comb support rod 570 and a comb mount 575. The comb support rod 570 is rigidly attached to the comb mount 575, permitting the body 560 and the teeth 525 to slide back and forth along the comb support rod 570. In some example embodiments, the comb mount 575 is part of the horizontal support 370 and couples the first comb section 382 to the horizontal support.

In some example embodiments, the comb support rod 570 is rectangular, limiting the rotation of the body 560.

In some example embodiments, the body 560 is manufactured from a low friction material (e.g., Delrin® acetal polymer) and the comb support rod 570 are manufactured from a stainless steel, thereby eliminating the use of a linear bearing.

Figure 5F:
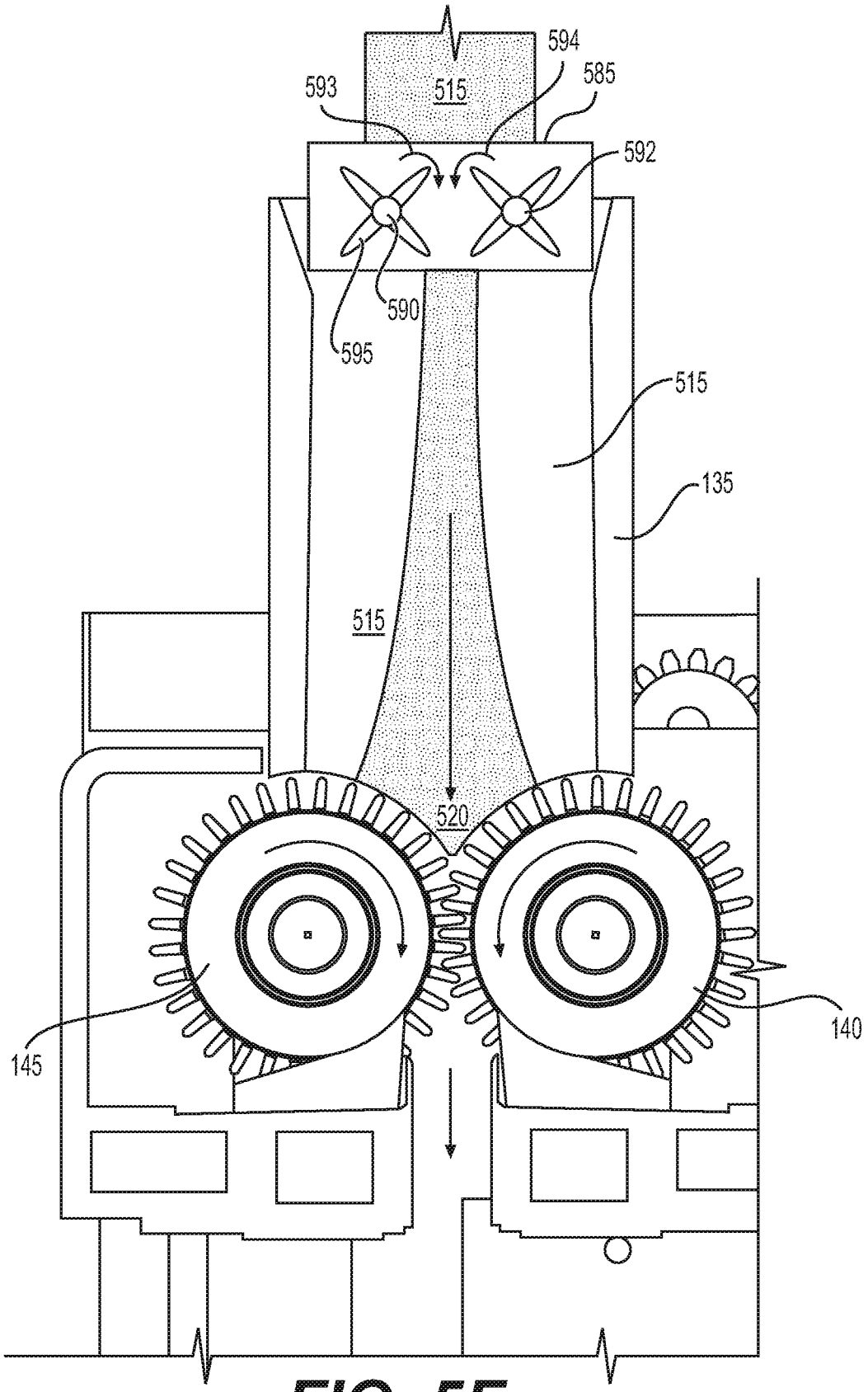
FIG. 5F illustrates another view of the processing system shown in FIG. 1.

FIG. 5F illustrates a zoomed out view of the cross-sectional view shown in FIG. SA. As shown in FIG. 5F, the hopper 135 contains the material 515 to be processed. A pre-distributer 585 may be on an opening 445 of the hopper 135 to distribute the material 515 into the hopper 135 and onto the first and second rollers 140 and 145.

In some example embodiments, the pre-distributer 585 may include two rotating shafts 590 and 592 that rotate in opposite directions as shown in FIG. 5F. The shaft 590 rotates in a direction 593 and the shaft rotates in a direction 594.

A plurality of paddles 595 are attached to each of the shafts 590 and 592 such that the paddles 595 attached to shaft 590 and the paddles 595 attached to the shaft 592 mesh when both the shaft 590 and the shaft 592 rotate.

FIGS. 6A-6D illustrate a roller according to example embodiments. In some example embodiments, a roller 600 may be the same as the first and second rollers 140 and 145. The roller 600 may include a cylindrical side 610 and a plurality of teeth 625 projecting from the cylindrical side 610.

Figure 6B:
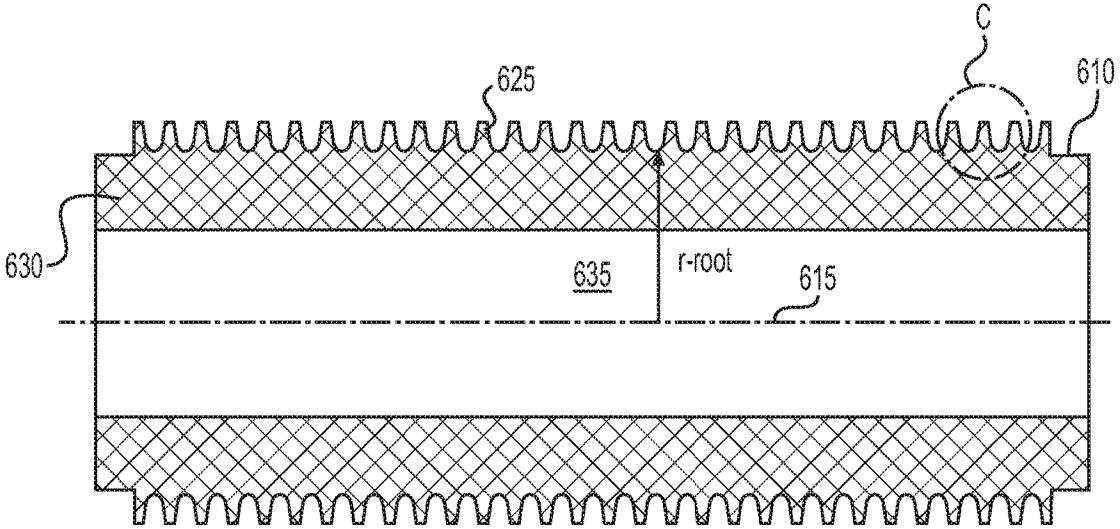
FIGS. 6A-6D illustrate a roller according to some example embodiments.
Figure 6A:
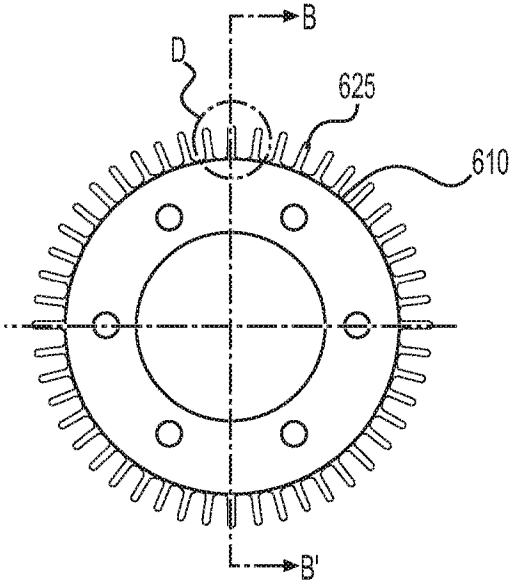

FIG. 6B illustrates a cross-sectional view of the roller 600 along the line B-B' shown in FIG. 6A. The roller 600 extends along a longitudinal axis 615. In some example embodiments, the roller 600 includes a body 630 defining a cylindrical channel 635 through the roller 600. The cylindrical channel 635 may extend along the longitudinal axis 615.

In some example embodiments, the body 630 and the teeth 625 may be made of the same materials. For example, the body 630 and the teeth 625 may be made of stainless steel, aluminum, another metal, a plastic material, a sub-combination thereof or a combination thereof. The teeth 625 may include a coating or surface treatment.

Figure 6D:
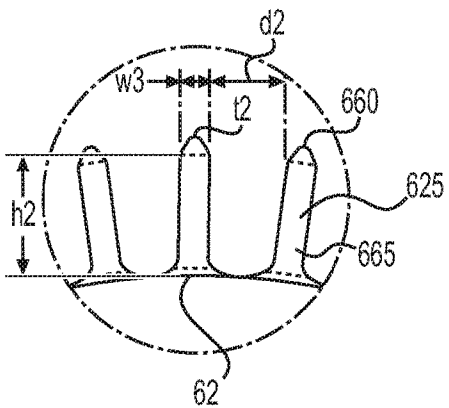
Figure 6C:
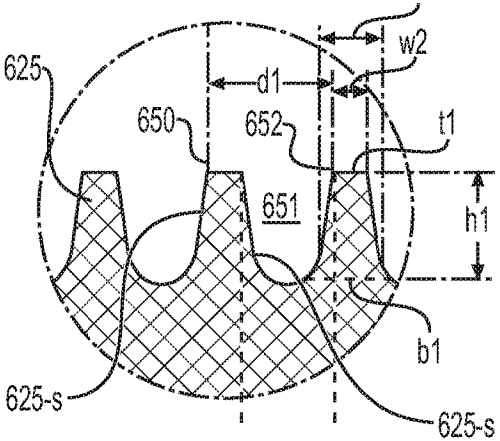

FIG. 6C illustrates a zoomed-in image of the area in C of FIG. 6B. A spacing and structure of the teeth 625, according to some example embodiments, are illustrated in FIG. 6C.

As shown from the cross-sectional view of FIG. 6C, the teeth 625 may be trapezoidal and spaced apart from each other by a distance of d1 along the longitudinal axis 615 of the roller 600. The distance d1 is measured between a leading edge 650 of a tooth and a leading edge 652 of a subsequent tooth. A width of a base b1 of each tooth 625 may be w1 and a width of a top t1 of each tooth may be w2. A height of each tooth 625 may be h1. The height h1 is the distance from the base b1 to the top t1. In some example embodiments, the distance d1 is 8 mm, the width w1 is 4.1 mm, the width w2 is 2 mm and the height h1 is 7.3 mm. In other example embodiments the ratio of d1:w1:w2:h1 is 4:2:1:4.

Two adjacent teeth define a space 651 for the fingers 535 and 540 of the first comb section 382 and the second comb section 384.

In some example embodiments as shown in FIGS. 5E and 6C, as the first and second rollers 140 and 145 oscillate, sides 650-*s* of the teeth 625 (or sides 525-*s*) engage the sides 535-*s* of the fingers 535, causing the fingers 535 and thus the first and second comb sections 382 and 384 to oscillate in tandem with the oscillating motion of the first and second rollers 140 and 145. As the direction of the linear motion of the first and second rollers 140 and 145 reverse, the fingers 535 move from one portion of the space 651 to the remaining portion, thus allowing the fingers 535 to clear material from the entire space 651. In some example embodiments, the space 651 is not large enough for a roller to oscillate without moving the fingers 535 and thus the first and second comb sections 382 and 384.

FIG. 6D illustrates a zoomed-in image of the area in D of FIG. 6A. A spacing and structure of the teeth 625 from an end view of the roller 600, according to some example embodiments, are illustrated in FIG. 6D.

As shown from the cross-sectional view of FIG. 6D, the teeth 625 may be trapezoidal and spaced apart from each other by a distance of d2.

As shown, each of the teeth 625 may have a side that includes a portion having a trapezoidal cross-section 660 and a portion having a rectangular cross-section 665. The distance d2 is the space between two adjacent teeth. A width w3 of each of the teeth 625 that portion having the rectangular cross-section may be w3. A height of each tooth 625 may be h2. The height h2 is the distance from a base b2 of the tooth 625 to a top t2 of the tooth 625. In some example embodiments, the distance d2 is 4.6 mm, the width w3 is 2 mm, and the height h2 is 8.1 mm. In other example embodiments, the ratio of d2:w3:h2 is 2:1:4.

In some example embodiments, the teeth 625 are rectangular when viewed from an end of the roller 600 (FIG. 6A), and trapezoidal when viewed from a side of the roller 600 (FIG. 6B). The dimensions and shape of the teeth 625 may vary depending upon the characteristics of the material 515 to be processed.

Figure 7:
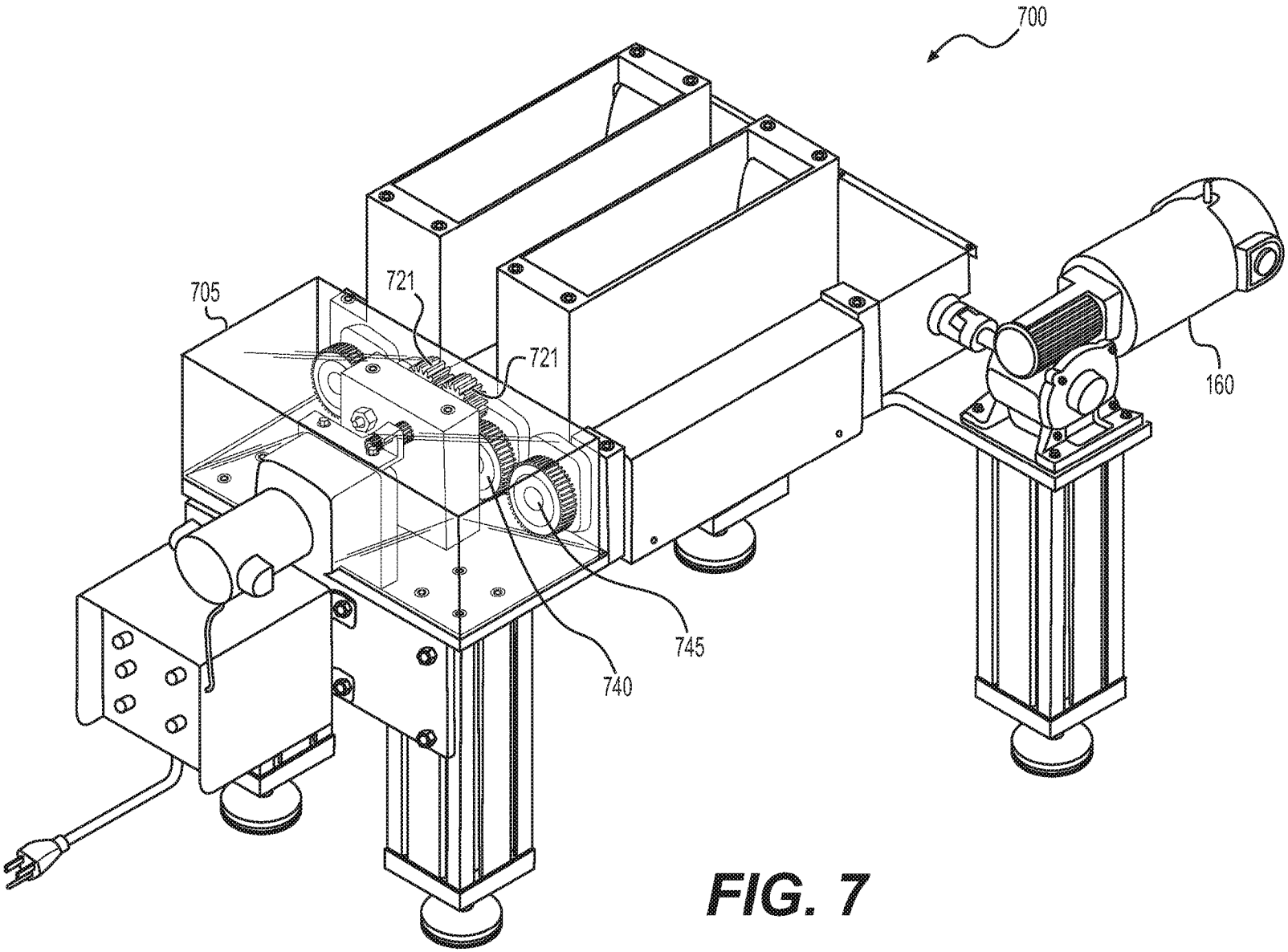
FIG. 7 illustrates a processing system including two pairs of rollers according to some example embodiments.

FIG. 7 illustrates example embodiments of a processing system including two pairs of rollers. In some example embodiments, a four roller system 700 operates in a same manner as the two roller system except a first drive system 705 of the four roller system 700 includes two pinion gears 721 to the pairs of rollers, respectively (shown in FIG. 7). Moreover, a second drive system 715 includes a third crank arm assembly and a fourth crank arm assembly. The third crank arm assembly is structured in the same manner and operates in the same manner as the first crank arm assembly 208. The fourth crank arm assembly is structured in the same manner and operates in the same manner as the second crank arm assembly 210. Rollers 740 and 745 form a pair of rollers that operate in the same manner as the first and second rollers 140 and 145.

Example embodiments have been disclosed herein, it should be understood that other variations may be possible. Such variations are not to be regarded as a departure from the spirit and scope of the present disclosure, and all such modifications as would be obvious to one skilled in the art are intended to be included within the scope of the following claims.

We claim:

1. A conditioning system comprising:
a first roller;
a second roller;
a first drive system including a first single motor, the first drive system configured to rotate the first roller in a first rotational direction using the first single motor and rotate the second roller in a second rotational direction using the first single motor;
a second drive system including a second single motor, the second drive system configured to move the first roller and the second roller in opposing linear directions, the first drive system and the second drive system being configured to cooperatively control the first roller and the second roller to process a substance;
a third roller;
a fourth roller, wherein the first drive system is configured to rotate the third roller in the first rotational direction and rotate the fourth roller in the second rotational direction;
a first comb structure adjacent to the first roller;
a second comb structure adjacent to the second roller;
a third comb structure adjacent the third roller; and
a fourth comb structure adjacent the fourth roller;
wherein the second drive system is configured to oscillate the first comb structure, the second comb structure, the third comb structure, and the fourth comb structure in a linear direction parallel to a length of the first roller, the second roller, the third roller, and the fourth roller.

2. The conditioning system of claim 1, further comprising:
a hopper configured to feed the substance to the first and second roller.

3. The conditioning system of claim 2, further comprising:
a pre-distributer configured to distribute the substance into the hopper.

4. The conditioning system of claim 1, wherein the second drive system is configured to move the first roller and the second roller such that the first roller and the second roller move the substance to between the first roller and the second roller.

5. The conditioning system of claim 1, wherein the first roller includes a plurality of first teeth and the second roller includes a plurality of second teeth, and the plurality of first teeth and the plurality of second teeth mesh with each other.

6. The conditioning system of claim 5, wherein the plurality of first teeth and the plurality of second teeth mesh with each other in a non-contact manner.

7. The conditioning system of claim 5, wherein:
the first comb structure and the second comb structure configured to remove the substance from the plurality of first teeth and the plurality of second teeth, respectively.

8. A conditioning system comprising:
a first roller including a plurality of first teeth;
a second roller including a plurality of second teeth;
a first drive system including a first single motor, the first drive system configured to rotate the first roller in a first rotational direction using the first single motor and rotate the second roller in a second rotational direction using the first single motor;

a second drive system including a second single motor, the second drive system configured to move the first roller and the second roller in opposing linear directions, the first drive system and the second drive system being configured to cooperatively control the first roller and the second roller to process a substance;

a first comb structure adjacent to the first roller; and a second comb structure adjacent to the second roller, the first comb structure and the second comb structure configured to remove the substance from the plurality of first teeth and the plurality of second teeth, respectively, wherein the second drive system is configured to oscillate the first comb structure and the second comb structure in a linear direction parallel to a length of the first roller and the second roller, and the second drive system is configured to oscillate the first comb structure in a same linear direction as the first roller and the second comb structure in a same linear direction as the second roller.

9. The conditioning system of claim 7, wherein the first comb structure is configured to move when the first drive system rotates the first roller.

10. The conditioning system of claim 9, wherein the second comb structure is configured to move when the second drive system rotates the second roller.

11. The conditioning system of claim 7, wherein the first comb structure includes a plurality of first fingers, at least a portion of the plurality of first fingers being between the plurality of first teeth.

12. The conditioning system of claim 11, wherein a structure of the plurality of first fingers corresponds to a root radius of the first roller.

13. The conditioning system of claim 1, wherein the second drive system includes spring return cams to move the first roller and the second roller.

14. The conditioning system of claim 1, wherein the second drive system includes an eccentric crank to move the first roller and the second roller.

15. The conditioning system of claim 1, wherein the second drive system is configured to move the third roller and the fourth roller in opposing linear directions.

16. The conditioning system of claim 1, wherein the substance is a fibrous material.

17. The conditioning system of claim 16, wherein the fibrous material is tobacco.

18. The conditioning system of claim 8, wherein the first comb structure includes a plurality of first fingers, at least a portion of the plurality of first fingers being between the plurality of first teeth.

19. The conditioning system of claim 18, wherein a structure of the plurality of first fingers corresponds to a root radius of the first roller.

20. The conditioning system of claim 1, wherein:

the first comb structure includes a first arced surface having a plurality of first fingers, the first arced surface configured to match a surface of the first roller;

the second comb structure includes a second arced surface having a plurality of second fingers, the second arced surface configured to match a surface of the second roller;

the third comb structure includes a third arced surface having a plurality of third fingers, the third arced surface configured to match a surface of the third roller; and the fourth comb structure includes a fourth arced surface having a plurality of fourth fingers, the fourth arced surface configured to match a surface of the fourth roller.

21. The conditioning system of claim 20, wherein the first arced surface, the second arced surface, the third arced surface, and the fourth arced surface each include an angled portion and a curved portion, the angled portion extending at an angle to the curved portion.

22. The conditioning system of claim 1, wherein the first combed structure, the second combed structure, the third combed structure, and the fourth combed structure each include a comb body, a comb support rod, and a comb mount, the comb body configured to move back and forth along the comb support rod.

* * * * *